US011839349B2

(12) United States Patent
Pohlman et al.

(10) Patent No.: US 11,839,349 B2
(45) **Date of Patent: *Dec. 12, 2023**

(54) SYSTEM AND METHOD FOR OPERATING A CLEANING SYSTEM BASED ON A SURFACE TO BE CLEANED

(71) Applicant: TECHTRONIC FLOOR CARE TECHNOLOGY LIMITED, Tortola (VG)

(72) Inventors: Kevin Pohlman, Tega Cay, SC (US); Christopher M. Charlton, Mint Hill, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 17/556,494

(22) Filed: Dec. 20, 2021

(65) Prior Publication Data

US 2022/0125262 A1 Apr. 28, 2022

Related U.S. Application Data

(63) Continuation of application No. 16/249,622, filed on Jan. 16, 2019, now Pat. No. 11,202,543.

(Continued)

(51) Int. Cl.

| | |
|---|---|
| ***A47L 9/28*** | (2006.01) |
| ***A47L 9/04*** | (2006.01) |
| ***A47L 11/40*** | (2006.01) |

(52) U.S. Cl.

CPC ..... *A47L 9/2826* (2013.01); *A47L 9/0411* (2013.01); *A47L 9/0477* (2013.01); *A47L 9/28* (2013.01);

(Continued)

(58) Field of Classification Search

CPC . A47L 9/2826; A47L 2201/04; A47L 2201/06

See application file for complete search history.

(56) References Cited

U.S. PATENT DOCUMENTS

| | | | |
|---|---|---|---|
| 4,351,078 | A | 9/1982 | Sternberg |
| 4,446,594 | A | 5/1984 | Watanabe et al. |

(Continued)

FOREIGN PATENT DOCUMENTS

| | | | |
|---|---|---|---|
| CN | 2448269 | Y | 9/2001 |
| EP | 1396222 | A2 | 3/2004 |

(Continued)

OTHER PUBLICATIONS

International Search Report and Written Opinion from the International Searching Authority for Application No. PCT/US2019/013819 dated May 16, 2019 (15 pages).

(Continued)

*Primary Examiner* — Andrew A Horton

(74) *Attorney, Agent, or Firm* — Michael Best & Friedrich LLP

(57) ABSTRACT

A cleaner including a base defining a suction chamber, a brush roll driven by a brush roll motor, a sensor configured to sense a parameter related to a floor; and a controller having a memory and electronic processor. The controller is configured to receive the parameter, control the brush roll motor based on the parameter and a first floor coefficient, determine a second floor coefficient based on the parameter, and control the brush roll motor based on the second floor coefficient.

23 Claims, 6 Drawing Sheets

Related U.S. Application Data

(60) Provisional application No. 62/618,129, filed on Jan. 17, 2018.

(52) U.S. Cl.
CPC ..... *A47L 9/2821* (2013.01); *A47L 9/2831* (2013.01); *A47L 9/2842* (2013.01); *A47L 9/2847* (2013.01); *A47L 9/2857* (2013.01); *A47L 11/4011* (2013.01); *A47L 11/4069* (2013.01)

(56) References Cited

U.S. PATENT DOCUMENTS

| | | | |
|---|---|---|---|
| 4,611,365 | A | 9/1986 | Komatsu et al. |
| 4,654,924 | A | 4/1987 | Getz et al. |
| 4,910,824 | A | 3/1990 | Nagayama et al. |
| 4,958,406 | A | 9/1990 | Toyoshima et al. |
| 5,023,973 | A | 6/1991 | Tsuchida et al. |
| 5,056,175 | A | 10/1991 | Stein et al. |
| 5,075,922 | A | 12/1991 | Tsuchida et al. |
| 5,105,502 | A | 4/1992 | Takashima |
| 5,136,750 | A | 8/1992 | Takashima et al. |
| 5,144,715 | A | 9/1992 | Matsuyo et al. |
| 5,243,732 | A | 9/1993 | Koharagi et al. |
| 5,255,409 | A | 10/1993 | Fujiwara et al. |
| 5,269,042 | A | 12/1993 | Stephens et al. |
| 5,276,939 | A | 1/1994 | Uenishi |
| 5,304,273 | A | 4/1994 | Oh et al. |
| 5,381,584 | A | 1/1995 | Jyoraku et al. |
| 5,440,216 | A | 8/1995 | Kim |
| 5,613,271 | A | 3/1997 | Thomas |
| 5,722,109 | A | 3/1998 | Delmas et al. |
| 5,881,430 | A | 3/1999 | Driessen et al. |
| 5,940,927 | A | 8/1999 | Haegermarck et al. |
| 6,076,227 | A | 6/2000 | Schallig et al. |
| 6,123,779 | A | 9/2000 | Conrad et al. |
| 6,167,588 | B1 | 1/2001 | Dyson |
| 6,255,792 | B1 | 7/2001 | Grasso et al. |
| 6,323,570 | B1 | 11/2001 | Nishimura et al. |
| 6,389,329 | B1 | 5/2002 | Colens |
| 6,400,048 | B1 | 6/2002 | Nisimura et al. |
| 6,437,465 | B1 | 8/2002 | Nishimura et al. |
| 6,446,302 | B1 | 9/2002 | Kasper et al. |
| 6,532,404 | B2 | 3/2003 | Colens |
| 6,605,156 | B1 | 8/2003 | Clark et al. |
| 6,800,140 | B2 | 10/2004 | Hansen |
| 6,810,305 | B2 | 10/2004 | Kirkpatrick, Jr. |
| 7,062,816 | B2 | 6/2006 | Kasper et al. |
| 7,079,923 | B2 | 7/2006 | Abramson et al. |
| 7,113,847 | B2 | 9/2006 | Chmura et al. |
| 7,167,775 | B2 | 1/2007 | Abramson et al. |
| 7,200,892 | B2 | 4/2007 | Kim |
| 7,203,993 | B2 | 4/2007 | Tondra et al. |
| 7,208,892 | B2 | 4/2007 | Tondra et al. |
| 7,220,930 | B2 | 5/2007 | Gordon et al. |
| 7,228,589 | B2 | 6/2007 | Miner et al. |
| 7,237,298 | B2 | 7/2007 | Reindle et al. |
| 7,320,149 | B1 | 1/2008 | Huffman et al. |
| 7,383,607 | B2 | 6/2008 | Johnson |
| 7,424,766 | B2 | 9/2008 | Reindle et al. |
| 7,444,206 | B2 | 10/2008 | Abramson et al. |
| 7,599,758 | B2 | 10/2009 | Reindle et al. |
| 7,603,744 | B2 | 10/2009 | Reindle |
| 7,617,557 | B2 | 11/2009 | Reindle |
| 7,698,777 | B2 | 4/2010 | Fujiwara et al. |
| 7,769,490 | B2 | 8/2010 | Abramson et al. |
| 7,801,645 | B2 | 9/2010 | Taylor et al. |
| 7,805,220 | B2 | 9/2010 | Taylor et al. |
| 7,861,352 | B2 | 1/2011 | Reindle |
| 7,900,310 | B2 | 3/2011 | Reindle |
| 7,921,509 | B2 | 4/2011 | Oh et al. |
| 7,941,896 | B2 | 5/2011 | Park et al. |
| 7,971,315 | B2 | 7/2011 | Kim et al. |
| 8,127,399 | B2 | 3/2012 | Dilger et al. |
| 8,311,674 | B2 | 11/2012 | Abramson |
| 8,346,389 | B2 | 1/2013 | Kim et al. |
| 8,607,402 | B2 | 12/2013 | Gerhards |
| 8,701,245 | B2 | 4/2014 | Charlton et al. |
| 8,789,235 | B2 | 7/2014 | Krebs et al. |
| 2004/0236468 | A1 | 11/2004 | Taylor et al. |
| 2005/0055792 | A1 | 3/2005 | Kisela et al. |
| 2005/0097701 | A1 | 5/2005 | Kushida et al. |
| 2005/0166354 | A1 | 8/2005 | Uehigashi |
| 2005/0166355 | A1 | 8/2005 | Tani |
| 2005/0171644 | A1 | 8/2005 | Tani |
| 2006/0048797 | A1 | 3/2006 | Jung et al. |
| 2006/0085095 | A1 | 4/2006 | Reindle et al. |
| 2006/0204383 | A1 | 9/2006 | Kushida et al. |
| 2008/0148807 | A1 | 6/2008 | Berry et al. |
| 2008/0314156 | A1 | 12/2008 | Kim |
| 2009/0133720 | A1 | 5/2009 | Van Den Bogert |
| 2010/0242224 | A1 | 9/2010 | Maguire et al. |
| 2010/0269857 | A1 | 10/2010 | Assmann et al. |
| 2010/0313910 | A1 | 12/2010 | Lee et al. |
| 2010/0318232 | A1 | 12/2010 | Tiekoetter et al. |
| 2011/0154589 | A1 | 6/2011 | Reindle |
| 2011/0252593 | A1 | 10/2011 | Gerhards |
| 2011/0265284 | A1 | 11/2011 | Morgan et al. |
| 2012/0125363 | A1 | 5/2012 | Kim et al. |
| 2012/0152280 | A1 | 6/2012 | Bosses et al. |
| 2012/0260944 | A1* | 10/2012 | Martins, Jr. ..... A47L 9/2842 15/340.1 |
| 2013/0008468 | A1 | 1/2013 | Bertram et al. |
| 2013/0008469 | A1 | 1/2013 | Yun et al. |
| 2013/0145572 | A1 | 6/2013 | Schregardus et al. |
| 2014/0000305 | A1 | 1/2014 | Platt |
| 2014/0075689 | A1 | 3/2014 | Windorfer |
| 2014/0109935 | A1 | 4/2014 | Jang et al. |
| 2014/0166047 | A1 | 6/2014 | Hillen et al. |
| 2014/0312813 | A1 | 10/2014 | Murchie et al. |
| 2016/0103451 | A1* | 4/2016 | Vicenti ..... A47L 11/4066 700/259 |

FOREIGN PATENT DOCUMENTS

| | | | |
|---|---|---|---|
| EP | 1689277 | A1 | 8/2006 |
| JP | H04250126 | A | 9/1992 |
| WO | 9707728 | A1 | 3/1997 |
| WO | 01028401 | A1 | 4/2001 |
| WO | 02069775 | A2 | 9/2002 |
| WO | 2004032696 | A2 | 4/2004 |
| WO | 2005082223 | A1 | 9/2005 |
| WO | 2009077177 | A1 | 6/2009 |
| WO | 2012130842 | A1 | 10/2012 |
| WO | 2012147230 | A1 | 11/2012 |
| WO | 2013079334 | A1 | 6/2013 |
| WO | 2014004131 | A1 | 1/2014 |
| WO | 2014032945 | A1 | 3/2014 |

OTHER PUBLICATIONS

European Patent Office Action for Application No. 19703860.7 dated Apr. 13, 2023 (4 pages).

* cited by examiner

SYSTEM AND METHOD FOR OPERATING A CLEANING SYSTEM BASED ON A SURFACE TO BE CLEANED

CROSS-REFERENCE TO RELATED APPLICATIONS

This application is a continuation of U.S. patent application Ser. No. 16/249,622, filed Jan. 16, 2019, which issued as U.S. Pat. No. 11,202,543 on Dec. 21, 2021, which claims priority to U.S. Provisional Patent Application No. 62/618,129, filed Jan. 17, 2018, the entire contents all of which are hereby incorporated by reference herein.

FIELD

Embodiments relate to cleaners, or cleaning systems, (for example, vacuum cleaners).

SUMMARY

Cleaning systems may be used to clean various floors having various floor types (for example, hardwood floors, carpet floors, tile floors, etc.). Different floor types may benefit from different modes of operation of the cleaning system. For example, a suction force and/or a brush roll may be operated in a first mode when operating the cleaning system over carpet floors and a second mode when operating the cleaning system over hardwood floors. The first and second modes may be determined using factory settings. However, these factory settings may not be optimal for a user's specific carpet or hardwood floors.

Thus, one embodiment provides a cleaner including a base defining a suction chamber, a brush roll driven by a brush roll motor, a sensor configured to sense a parameter related to a floor; and a controller having a memory and electronic processor. The controller is configured to receive the parameter, control the brush roll motor based on the parameter and a first floor coefficient, determine a second floor coefficient based on the parameter, and control the brush roll motor based on the second floor coefficient.

Another embodiment provides a method of calibrating a cleaner. The method including sensing, via a sensor, a first parameter at a first time, the first parameter related to a first floor surface, and sensing, via the sensor, a second parameter at a second time, the second parameter related to a second floor surface. The method further including determining, via a controller, a floor coefficient based on the first parameter and the second parameter, and controlling a motor of the cleaner based on the floor coefficient.

Yet another embodiment provides a method of calibrating a cleaner. The method including sensing, via a sensor, an array of sensed characteristics related to a floor, determining, via a controller, a floor coefficient based on the array of sensed characteristics, and controlling a motor of the cleaner based on the floor coefficient.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways.

Figure 1:
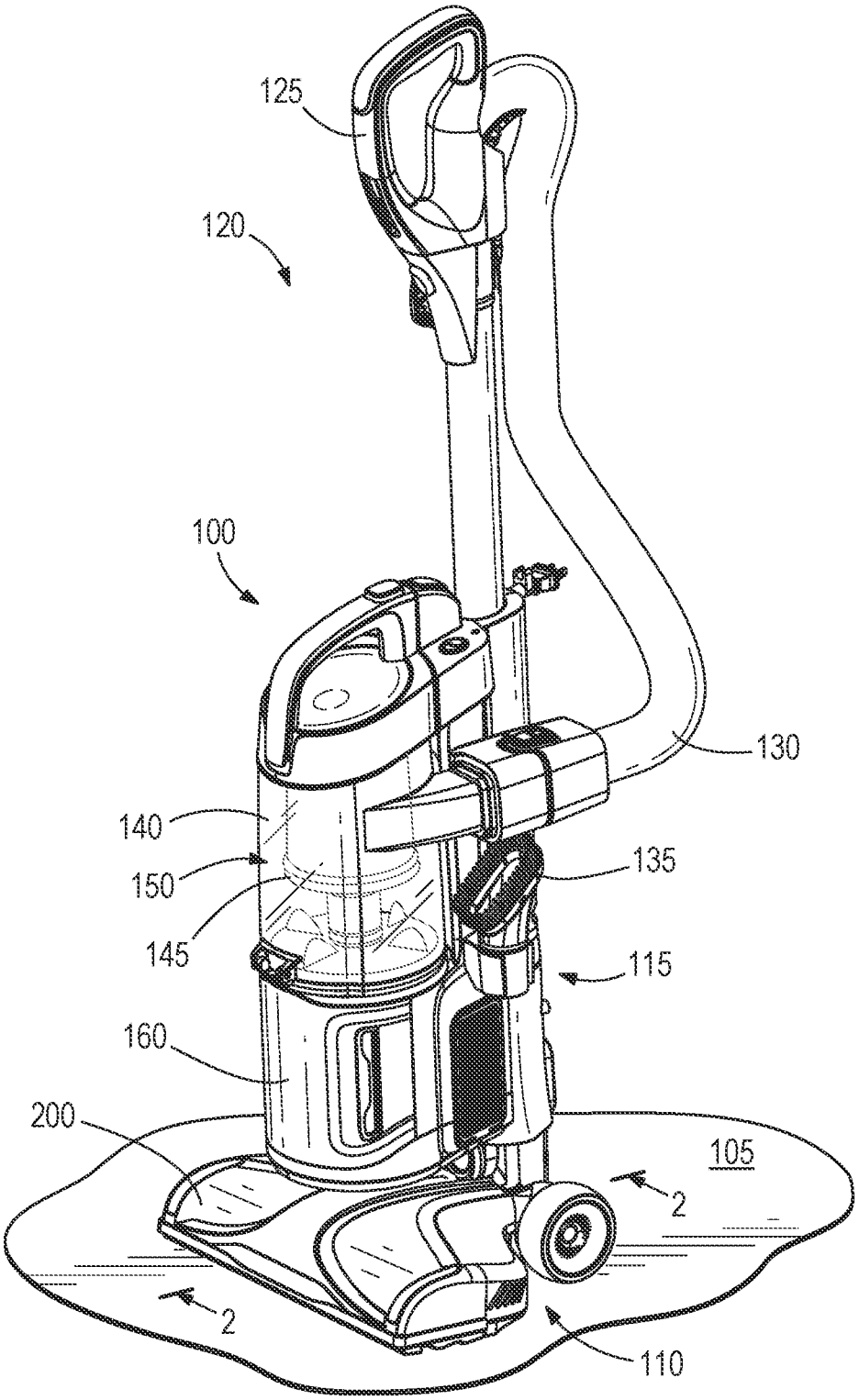
FIG. 1 is a perspective view of a cleaning system according to some embodiments.

FIG. 1 is a perspective view of a cleaning system 100 according to some embodiments. The cleaning system 100 is configured to clean a surface 105 (for example, a floor such as a hardwood floor, a carpeted floor, etc.). The cleaning system 100 may be a vacuum, such as but not limited to, an upright vacuum cleaner, a handheld vacuum cleaner, and a stick vacuum cleaner.

The cleaning system 100 may include a base assembly 110 and a handle assembly 115. The base assembly 110 is configured to move along the surface 105 to be cleaned. The handle assembly 115 extends from the base assembly 110 and allows the user to move and manipulate the base assembly 110 along the surface 105. In some embodiments, the handle assembly 115 is pivotably coupled to the base assembly 110, such that the handle assembly 115 may be in an upright position (as illustrated in FIG. 1) and an inclined position.

The handle assembly 115 may include a handle 120 having a grip 125 for a user to grasp. As illustrated, in some embodiments, the handle assembly may further include a detachable wand 130 and optionally an accessory tool 135 (for example, a crevice tool, an upholstery tool, a pet tool, etc.). In some embodiments, the accessory tool 135 is detachably coupled to the handle assembly 115 for storage and may be used in conjunction with the wand 130 for specialized cleaning.

The handle assembly 115 may further include, and/or support, a canister 140 having a separator 145 and a dirt receptacle 150. The separator 145 removes dirt particles from an airflow drawn into the cleaning system 100 that are then collected by the dirt receptacle 150. The separator 145 may be a cyclonic separator, a filter bag, and/or another separator.

The cleaning system 100 may further includes a suction motor 155 (FIG. 3) contained within a motor housing 160 of the handle assembly 115. In some embodiments, the suction motor 155 is coupled to a suction source, such as but not limited to, an impeller or fan assembly driven by the suction motor 155.

Figure 2:
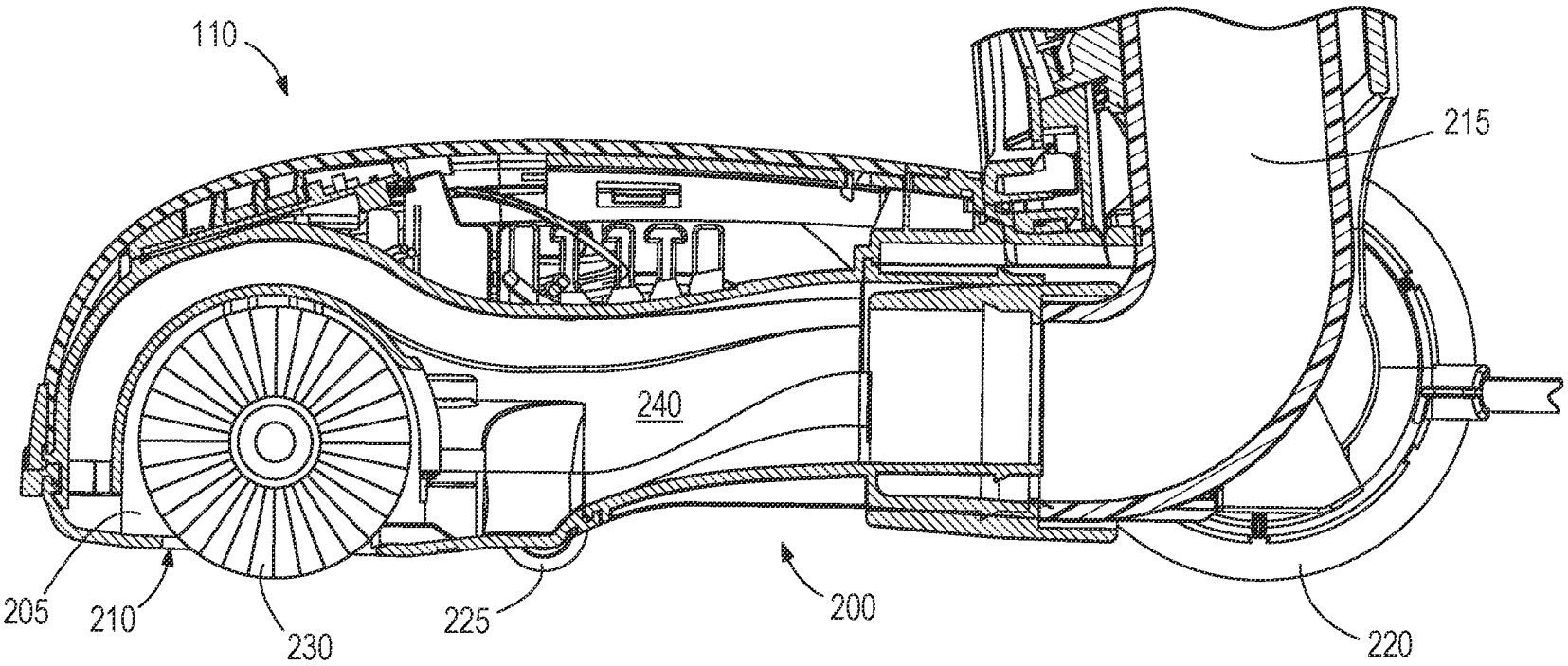
FIG. 2 is a cutaway view of a base assembly of the cleaning system of FIG. 1 according to some embodiments.

FIG. 2 illustrates an enlarged view of the base assembly 110 according to some embodiments. The base assembly 110 may include a floor nozzle 200 having suction chamber 205. The suction chamber 205 may be configured to draw air and/or debris through an inlet opening 210. After entering the suction chamber 205, air and/or debris may pass through a nozzle outlet 215, which may be in fluid communication with the separator 145 and/or suction motor 155.

In some embodiments, the base assembly 110 further includes one or more wheels 220 and one or more front supporting element, or front wheels, 225. The wheels 220, 225 facilitate movement of the base assembly 110 along the surface 105. In some embodiments, the wheels 220, 225 are motorized and/or directionally controlled (for example, in a robotic vacuum).

As illustrated, the base assembly 110 may further include an agitator, or brush roll, 230. The brush roll 230 may be supported within the nozzle suction chamber 205. The brush roll 230 is configured to agitate debris on the surface 105. The brush roll 230 may be driven via a brush roll motor 235 (FIG. 3).

The base assembly 110 may further include a sensor 240 in communication with the suction chamber 205. In some embodiments, sensor 240 is a pressure sensor configured to sense a pressure of the floor nozzle 200 (including a pressure of the suction chamber 205, the inlet opening 210, and/or the nozzle outlet 215). In some embodiments, the sensor 240 may be configured to sense a pressure of other types of nozzles, including but not limited to, an accessory wand and other types of above-floor cleaning attachments.

In operation, the suction motor 155 drives the suction source (for example, the fan assembly) to generator airflow through the cleaning system 100. The airflow enters the floor nozzle 200 through the inlet opening 210 and flows into the suction chamber 205. The airflow, along with any debris entrained therein, travels through the nozzle outlet 215 and into the separator 145. The separator 145 filters, or otherwise cleans the airflow, and directs the debris into the dirt receptacle 150. The filtered, or cleaned, air is then exhausted back into the environment through one or more outlet air openings.

Figure 3:
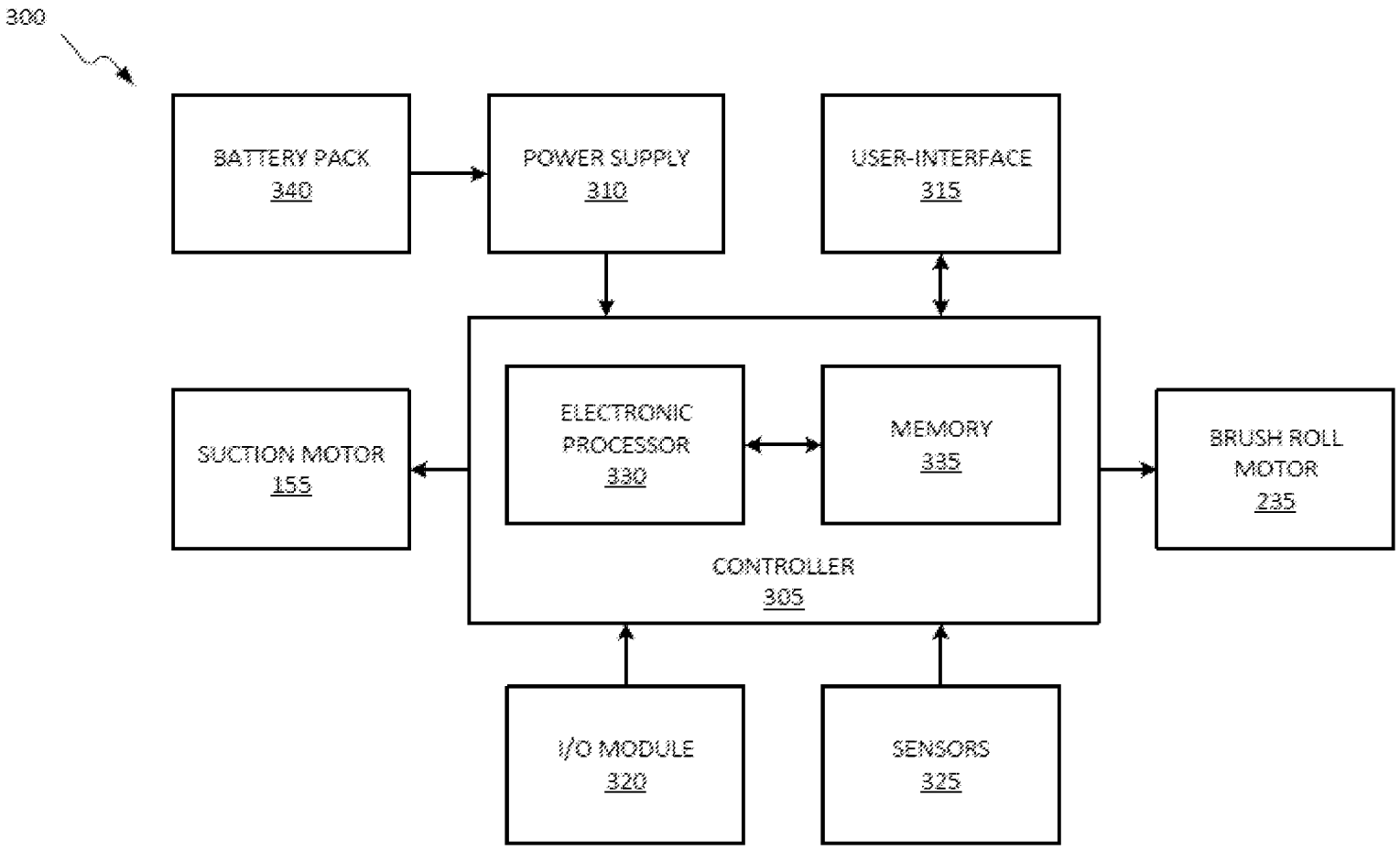
FIG. 3 is a block diagram of a control system of the cleaning system of FIG. 1 according to some embodiments.

FIG. 3 is a block diagram of a control system 300 of the cleaning system 100 according to some embodiments. The control system 300 includes a controller 305. The controller 305 is electrically and/or communicatively connected to a variety of modules or components of the cleaning system 100. For example, the controller 305 is connected to the suction motor 155, the brush roll motor 235, a power supply 310, a user-interface 315, an input/output (I/O) module 320, and one or more sensor 325.

In some embodiments, the controller 305 includes a plurality of electrical and electronic components that provide power, operational control, and protection to the components and modules within the controller 305 and/or the cleaning system 100. For example, the controller 305 includes, among other things, an electronic processor 330 (for example, a microprocessor or another suitable programmable device) and the memory 335.

The memory 335 includes, for example, a program storage area and a data storage area. The program storage area and the data storage area can include combinations of different types of memory, such as read-only memory (ROM), random access memory (RAM). Various non-transitory computer readable media, for example, magnetic, optical, physical, or electronic memory may be used. The electronic processor 330 is communicatively coupled to the memory 335 and executes software instructions that are stored in the memory 335, or stored on another non-transitory computer readable medium such as another memory or a disc. The software may include one or more applications, program data, filters, rules, one or more program modules, and other executable instructions.

Power supply 310 is configured to supply nominal power to the controller 305 and/or other components of the cleaning system 100. As illustrated, in some embodiments, the power supply 310 receives power from a battery pack 340 and provides nominal power to the controller 305 and/or other components of the cleaning system 100. In some embodiments, the power supply 310 may include DC-DC converters, AC-DC converters, DC-AC converters, and/or AC-AC converters. The battery pack 340 may be a rechargeable battery pack including one or more battery cells having a lithium-ion, or similar chemistry. In other embodiments, the power supply 310 may receive power from an AC power source (for example, an AC power outlet).

The user-interface 315 is configured to receive input from a user and output information concerning the cleaning system 100. In some embodiments, the user-interface 315 includes a display (for example, a primary display, a secondary display, etc.), an indicator (for example, a light-emitting diode (LED)), and/or input devices (for example, touch-screen displays, a plurality of knobs, dials, switches, buttons, etc). The display may be, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc.

The I/O module 320 is configured to provide communication between the cleaning system 100 an external device (for example, a smart phone, a tablet, a laptop, etc.). In such an embodiment, the cleaning system 100 may communicate with the one or more external devices through a network. The network is, for example, a wide area network (WAN) (e.g., the Internet, a TCP/IP based network, a cellular network, such as, for example, a Global System for Mobile Communications [GSM] network, a General Packet Radio Service [GPRS] network, a Code Division Multiple Access [CDMA] network, an Evolution-Data Optimized [EV-DO] network, an Enhanced Data Rates for GSM Evolution [EDGE] network, a 3GSM network, a 4GSM network, a Digital Enhanced Cordless Telecommunications [DECT] network, a Digital AMPS [IS-136/TDMA] network, or an Integrated Digital Enhanced Network [iDEN] network, etc.). In other embodiments, the network is, for example, a local area network (LAN), a neighborhood area network (NAN), a home area network (HAN), or personal area network (PAN) employing any of a variety of communications protocols, such as Wi-Fi, Bluetooth, ZigBee, etc. In yet another embodiment, the network includes one or more of a wide area network (WAN), a local area network (LAN), a neighborhood area network (NAN), a home area network (HAN), or personal area network (PAN).

The one or more sensors 325 are configured to sense one or more characteristics of the cleaning system 100 related to floor type. In some embodiments, the one or more sensors 325 include a voltage sensor, a current sensor, an ultrasonic sensor, and/or an infrared sensor. In some embodiments, the one or more sensors 325 include sensor 240. In some embodiments, the one or more sensors 325 are configured to sense a voltage and/or a current provided to the suction motor 155 and/or the brush roll motor 235. In other embodiments, the one or more sensors 325 are configured to sense an ultrasonic or infrared signal reflected from the floor.

In general operation, the controller 305 receives sensed characteristics from the one or more sensors 325 and provides power to the suction motor 155 and/or the brush roll motor 235 based on the sensed characteristics. In some embodiments, the controller 305 controls the suction motor 155 and/or brush roll motor 235 based on a floor coefficient. In some embodiments, the floor coefficient is a threshold corresponding to a sensed parameter of the surface 105. In such an embodiment, the threshold may be a voltage and/or current threshold applied to the suction motor 155 and/or the brush roll motor 235. In other embodiments, the threshold may be a pressure. The controller 305 may determine the floor-type of the surface 105 based on the floor coefficient. For example, if a sensed characteristic (for example, current, voltage, and/or pressure) is below the floor coefficient, the surface 105 may be a first floor-type (for example, a hard floor), however, if the sensed characteristic is above the floor coefficient, the surface 105 may be a second floor-type (for example, a carpet floor). Stated another way, the controller 305 receives a sensor output signal corresponding to the sensed characteristics from the one or more sensors 325 and provides power to the suction motor 155 and/or the brush roll motor 235 based on the sensor output signal relative to the floor coefficient. The controller 305 may operate the suction motor 155 and/or the brush roll motor 235 in a first mode if the sensor output signal is below the floor coefficient and may operate the suction motor 155 and/or the brush roll motor 235 in a second mode if the sensor output signal is above the floor coefficient.

The controller 305 may then operate the cleaning system 100 based on the floor-type of the surface 105. For example, if the surface 105 is a hard floor, the cleaning system 100 may decrease the speed of the brush roll 230 or deactivate the brush roll 230. If the surface 105 is a carpet floor, the cleaning system 100 may increase the speed of the brush roll 230. As another example, if the surface 105 is a hard floor, the cleaning system 100 may decrease the speed of the suction motor 155. If the surface 105 is a carpet floor, the cleaning system 100 may increase the speed of the suction motor 155.

Figure 4:
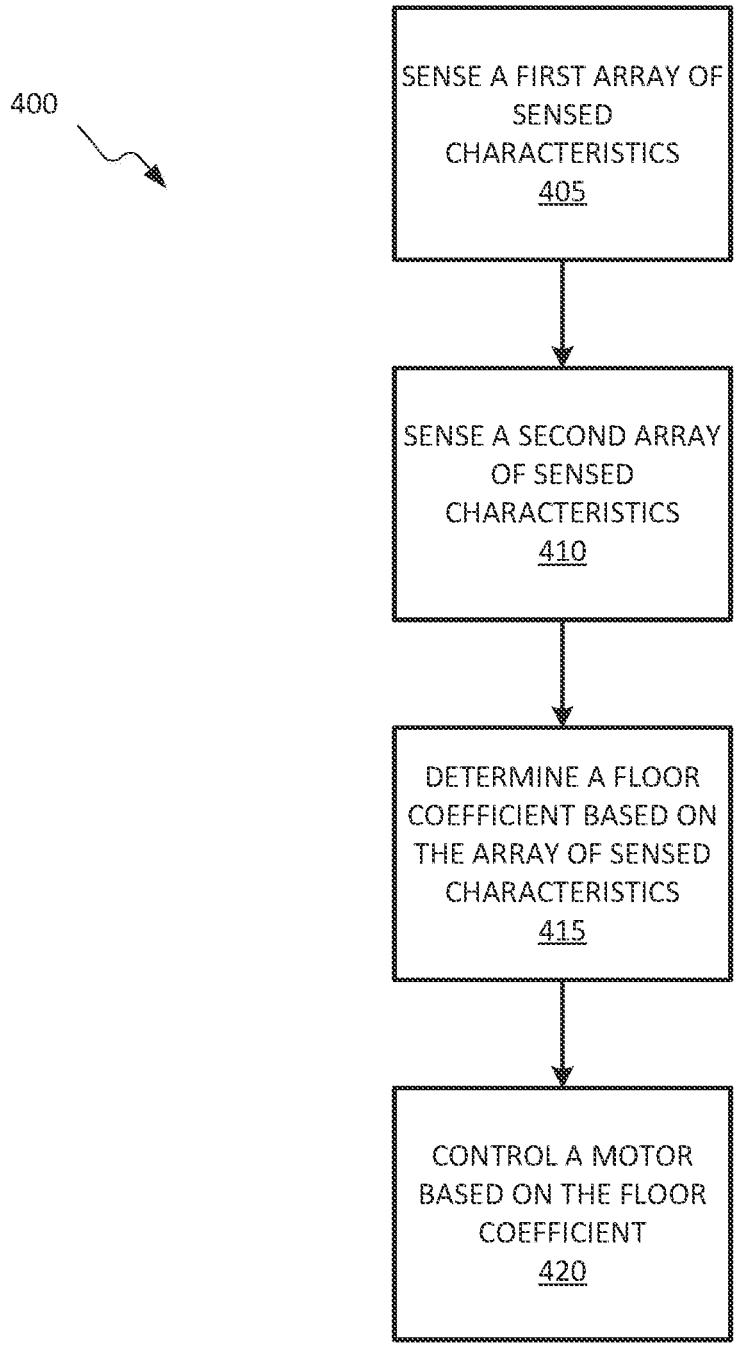
FIG. 4 is a flowchart illustrating an operation of the cleaning system of FIG. 1 according to some embodiments.

FIG. 4 is a flowchart illustrating a process, or operation, 400 for determining a floor coefficient according to some embodiments. It should be understood that the order of the steps disclosed in process 400 could vary. Furthermore, additional steps may be added and not all of the steps may be required. In some embodiments, process 400 is initiated once the cleaning system 100 receives a signal from an external device (for example, via I/O module 320). In such an embodiment, the signal may be communicated using Bluetooth or a similar wireless protocol. In some embodiments, process 400 is performed by the electronic processor 330 of the controller 305. In other embodiments, process 400 is performed externally of the cleaning system 100 (for example, via a server and/or the external device such as a mobile phone application, or a factory test station, or a computer or other external device).

As shown in FIG. 4, a first array of sensed characteristics related to a first surface (for example, a hard floor) is determined (block 405). In some embodiments, the array is determined by operating the cleaning system 100 on the first surface and capturing a predetermined number (such as at least ten, or twenty, or thirty, or other predetermined number) of sensed values (for example, sensed pressure values from pressure sensor 240 and/or sensed current provided to the brush roll motor 235). Alternatively, the array is determined by operating the cleaning system 100 on the first surface for a predetermined duration and capturing a number of sensed values during the duration. A second array of sensed characteristics related to a second surface (for example, a carpet floor) is then determined (block 410). A floor coefficient is then determined based on the array of sensed characteristics (block 415). A motor (for example, suction motor 155 and/or brush roll motor 235) is then controlled based on the floor coefficient (block 420). For example, a user may be prompted by a mobile phone application, or a factory test station, or a computer, or other external device, to operate the cleaning system 100 on the first surface for a duration sufficient to capture a desired number of sensed values (for example at least thirty) creating the first array. Then, the user may be prompted to operate the cleaning system 100 on the second surface for a duration sufficient to capture a desired number of sensed values (for example at least thirty) creating the second array, and the floor coefficient is then determined based on the first and second arrays of sensor outputs.

Figure 5:
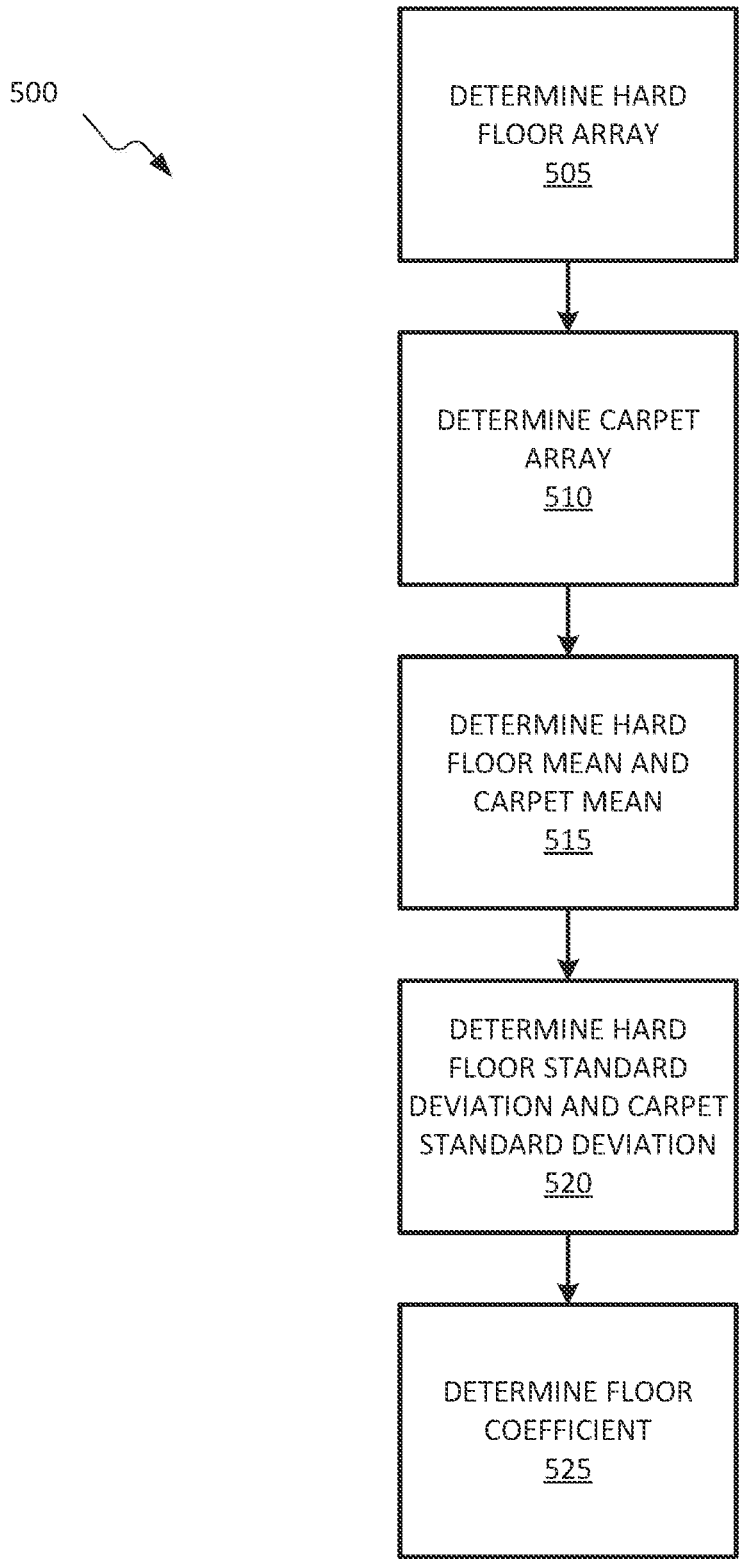
FIG. 5 is a flowchart illustrating an operation of the cleaning system of FIG. 1 according to some embodiments.

FIG. 5 is a flowchart illustrating a process, or operation, 500 for determining a floor coefficient for a surface 105 according to some embodiments. It should be understood that the order of the steps disclosed in process 500 could vary. Furthermore, additional steps may be added and not all of the steps may be required. In some embodiments, process 500 is initiated once the cleaning system 100 receives a signal from an external device (for example, via I/O module 320). In such an embodiment, the signal may be communicated using Bluetooth or a similar wireless protocol. In some embodiments, process 500 is performed by the electronic processor 330 of the controller 305. In other embodiments, process 500 is performed externally of the cleaning system 100 (for example, via a server and/or the external device such as a mobile phone application, or a factory test station, or a computer or other external device).

As shown in FIG. 5, a hard floor array (Array_Hardfloor) is determined (block 505). In some embodiments, the hard floor array is determined by operating the cleaning system 100 on a hard floor and capturing a predetermined number (such as at least ten, or twenty, or thirty, or other predetermined number) of sensed values (for example, sensed pressure values from pressure sensor 240 and/or sensed current provided to the brush roll motor 235). Alternatively, the hard floor array is determined by operating the cleaning system 100 on the hard floor for a predetermined duration and capturing a number of sensed values during the duration. A carpet array (Array_Carpet) is then determined (block 510). In some embodiments, the carpet array is determined by operating the cleaning system 100 on a carpet and capturing a predetermined number (such as at least ten, or twenty, or thirty, or other predetermined number) of sensed values (for example, sensed pressure values from pressure sensor 240 and/or sensed current provided to the brush roll motor 235). Alternatively, the carpet array is determined by operating the cleaning system 100 on the carpet for a predetermined duration and capturing a number of sensed values during the duration.

Once the hard floor and carpet arrays are determined, a hard floor mean (Mean_Hardfloor) and a carpet mean (Mean_Carpet) may be calculated (block 515). In some embodiments, the hard floor mean and the carpet mean are calculated using Equation 1 and Equation 2, respectively.

$$\text{Mean_Hardfloor}=\Sigma_{i=1}^{n} n_i/\text{length(Array_Hardfloor)} \quad \text{[Equation 1]}$$

$$\text{Mean_Carpet}=\Sigma_{i=1}^{\alpha} \alpha_i/\text{length(Array_Carpet)} \quad \text{[Equation 2]}$$

A hard floor standard deviation (St_dev_hardfloor) and a carpet standard deviation (St_dev_carpet) may then be calculated (block 520). In some embodiments, the hard floor standard deviation and the carpet standard deviation are calculated using Equation 3 and Equation 4, respectively.

$$St_dev_\text{Hardfloor}=\sqrt{\Sigma_{i=1}^{n}(n_i-\text{Mean_Hardfloor})^2)/(n-1)} \quad \text{[Equation 3]}$$

$$St_dev_\text{Carpet}=\sqrt{\Sigma_{i=1}^{\alpha}(\alpha_i-\text{Mean_Carpet})^2)/(\alpha-1)} \quad \text{[Equation 4]}$$

A floor coefficient (Coefficient) may then be calculated (block 525). In some embodiments, the hard floor coefficient and the carpet floor coefficient are calculated using Equation 5, Equation 6, and Equation 7.

$$\text{Z_score_Hardfloor} = \frac{\text{Coefficient} - \text{Mean_Hardfloor}}{\text{St_dev_Hardfloor}} \quad \text{[Equation 5]}$$

$$\text{Z_score_Carpet} = \frac{\text{Coefficient} - \text{Mean_Carpet}}{\text{St_dev_Carpet}} \quad \text{[Equation 6]}$$

$$\text{Where, Z_score_Hardfloor} + \text{Z_score_Carpet} = 0 \quad \text{[Equation 7]}$$

In some embodiments, the cleaning system 100 is initially operated using a preset, or predetermined, floor coefficient. In such an embodiment, the preset floor coefficient may be a preset factory floor coefficient. In such an embodiment, the cleaning system 100 may calibrate the floor coefficient. For example, a user may be prompted by a mobile phone application, or a factory test station, or a computer, or other external device, to operate the cleaning system 100 on the hard floor for a duration sufficient to capture a desired number of sensed values (for example at least thirty) creating the hard floor array. Then, the user may be prompted to operate the cleaning system 100 on the carpet for a duration sufficient to capture a desired number of sensed values (for example at least thirty) creating the carpet array, and the floor coefficient is then determined based on the hard floor and carpet arrays.

Figure 6:
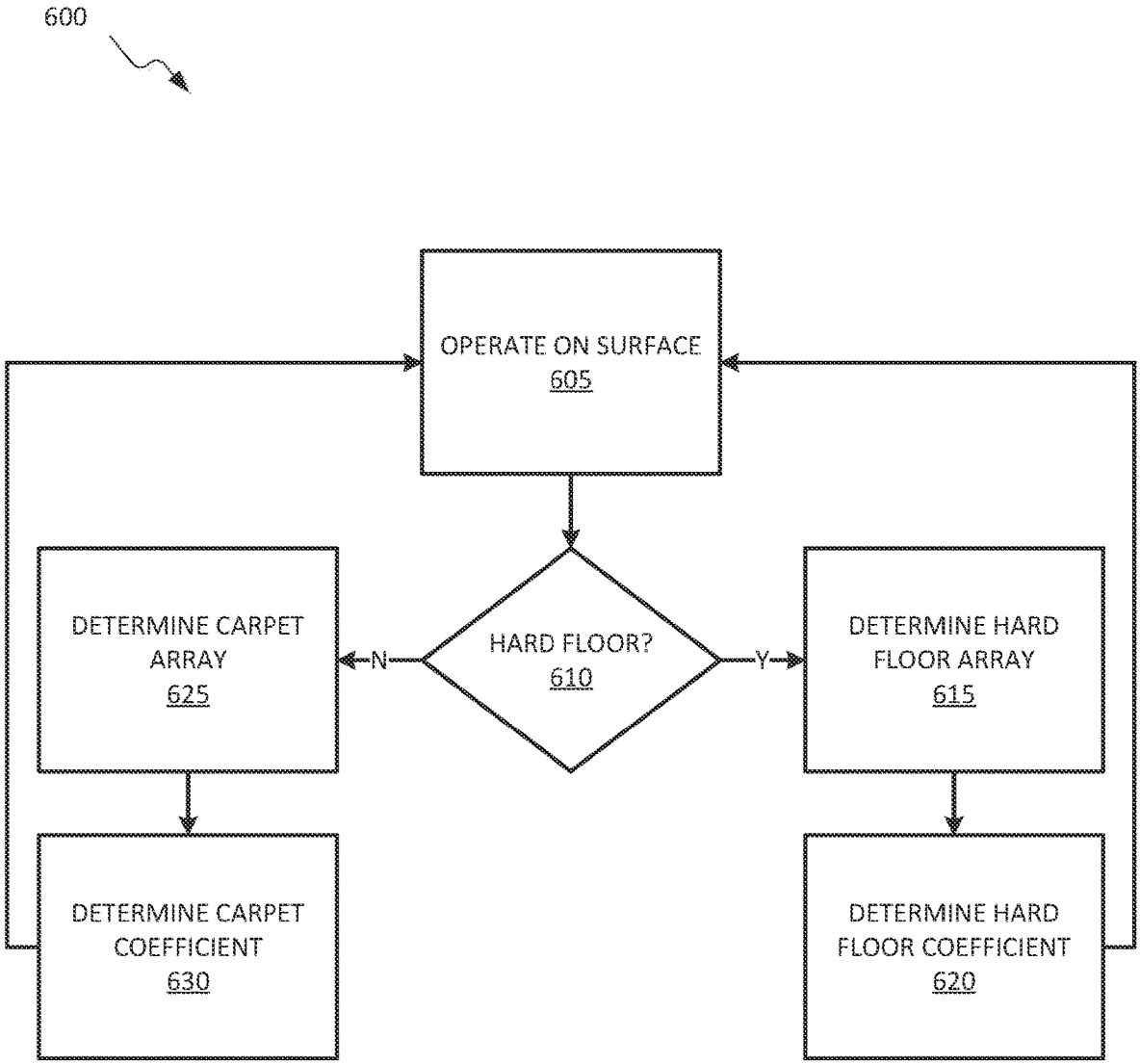
FIG. 6 is a flowchart illustrating an operation of the cleaning system of FIG. 1 according to some embodiments.

FIG. 6 is a flowchart illustrating a process, or operation, 600 for determining a calibrated floor coefficient for a surface 105 according to some embodiments. It should be understood that the order of the steps disclosed in process 600 could vary. Furthermore, additional steps may be added and not all of the steps may be required. In some embodiments, process 600 is performed by the electronic processor 330 of the controller 305. In other embodiments, process 600 is performed externally of the cleaning system 100 (for example, via a server and/or the external device).

As shown in FIG. 6, the cleaning system 100 operates on a surface 105 (block 605). While operating, the cleaning system 100 determines if the surface 105 is a hard floor (block 610). In some embodiments, the cleaning system 100 may determine if the surface 105 is a hard floor based on one or more sensed characteristics and a stored floor coefficient, which may be a factory-preset floor coefficient or a previously calibrated floor coefficient.

If the surface 105 is a hard floor, the cleaning system 100 determines a hard floor array and stores the hard floor array (block 615). If the surface 105 is not a hard floor, and thus a carpet floor, the cleaning system 100 determines a carpet array (block 620). The cleaning system 100 then determines if both a hard floor array and a carpet array have been stored (620). If both arrays have not been stored, process 600 cycles back to block 605. If both arrays have been stored, the cleaning system 100 calculated a calibrated floor coefficient using the hard floor array and the carpet array (block 630). Process 600 then cycles back to block 605 and the cleaning system 100 operates using the calibrated floor coefficient.

In some embodiments, process 600 is performed routinely as the user operates the cleaning system 100. Thus, in such an embodiment, the cleaning system 100 constantly recalibrates one or more floor coefficients in order to operate at optimal settings.

Thus, the application provides, among other things, a cleaning system and method for operating the same. Various features and advantages of the application are set forth in the following claims.

What is claimed is:

1. A cleaner comprising:
- a base defining a suction chamber;
- a brush roll driven by a brush roll motor;
- a sensor configured to sense a parameter related to a floor; and
- a controller having a memory and electronic processor, the controller configured to:
  - receive a first calibration parameter related to a first floor surface from the sensor;
  - receive a second calibration parameter related to a second floor surface from the sensor;
  - determine a calibrated floor coefficient based on the first calibration parameter and the second calibration parameter; and
  - control the brush roll motor based on the calibrated floor coefficient.

2. The cleaner of claim 1, further comprising a communications module configured to communicate with an external device.

3. The cleaner of claim 2, wherein the controller is further configured to receive, by the communications module, an instruction to determine the calibrated floor coefficient from the external device.

4. The cleaner of claim 3, wherein the external device is a mobile phone.

5. The cleaner of claim 1, wherein the controller is further configured to control the brush roll motor based on a preset floor coefficient before the calibrated floor coefficient is determined.

6. The cleaner of claim 1, wherein the controller is further configured to:
- calculate a first mean of the first calibration parameter and a second mean of the second calibration parameter;
- calculate a first standard deviation of the first calibration parameter and a second standard deviation of the second calibration parameter; and
- calculate the calibrated floor coefficient based on the first mean, the second mean, the first standard deviation, and the second standard deviation.

7. A method of calibrating a cleaner, the method comprising:
- controlling a motor of the cleaner based on a first floor coefficient;
- receiving, from an external device, a signal to initiate calibration of the cleaner;
- responsive to receiving the signal, determining, via a controller, a second floor coefficient based on a first parameter related to a first floor surface and a second parameter related to a second floor surface; and
- controlling the motor based on the second floor coefficient.

8. The method of claim 7, wherein determining the second floor coefficient includes:
- prompting, via the external device, a user to operate the cleaner on the first floor surface at a first time; and
- sensing, via a sensor, the first parameter.

9. The method of claim 8, wherein determining the second floor coefficient further includes:
- prompting, via the external device, the user to operate the cleaner on the second floor surface at a second time; and
- sensing, via the sensor, the second parameter.

10. The method of claim 9, wherein determining the second floor coefficient further includes:
- calculating a mean of the first parameter and the second parameter;

calculating a standard deviation of the first parameter and the second parameter; and calculating the floor coefficient based on the mean and the standard deviation.

11. The method of claim 7, wherein the external device is wirelessly connected to the cleaner.

12. The method of claim 7, wherein the external device is a mobile phone.

13. The method of claim 7, wherein the first floor coefficient is a factory preset floor coefficient.

14. The method of claim 7, wherein the motor of the cleaner is a suction motor that drives a suction source of the cleaner.

15. The method of claim 7, wherein the motor of the cleaner is a brush roll motor that drives a brush roll of the cleaner.

16. The method of claim 7, wherein the first parameter related to the first floor surface and the second parameter related to the second floor surface are based on a pressure that is sensed, via a sensor.

17. A cleaning system comprising:

a cleaner including:

a base defining a suction chamber;

a brush roll driven by a brush roll motor; and a sensor configured to sense a parameter related to a floor; and an external device including a controller having a memory and electronic processor, the controller configured to:

receive a first calibration parameter related to a first floor surface from the sensor;

receive a second calibration parameter related to a second floor surface from the sensor; and determine a calibrated floor coefficient based on the first calibration parameter and the second calibration parameter.

18. The cleaning system of claim 17, wherein the external device is a mobile phone.

19. The cleaning system of claim 18, wherein the controller is further configured to prompt a user to operate the cleaner on the first floor surface at a first time.

20. The cleaning system of claim 19, wherein the controller is further configured to prompt a user to operate the cleaner on the second floor surface at a second time.

21. The cleaning system of claim 17, wherein the external device is a server.

22. The cleaning system of claim 17, wherein the external device is wirelessly connected to the cleaner.

23. The cleaning system of claim 17, wherein the first floor surface is a carpeted surface and the second floor surface is a hard surface.

* * * * *